US006089225A

United States Patent [19]

Brown et al.

[11] Patent Number: 6,089,225

[45] Date of Patent: Jul. 18, 2000

[54] SYSTEM AND METHOD TO PREVENT THE TRANSMISSION OF PATHOGENIC ENTITIES BETWEEN THE MULTIPLE USERS OF SECOND STAGE REGULATORS

[76] Inventors: Richard I. Brown, 2335 Peachtree La., Northbrook, Ill. 60062; David S. Brown, 7940 Dada Dr., Gurnee, Ill. 60031

[21] Appl. No.: 09/182,619

[22] Filed: Oct. 29, 1998

[51] Int. Cl.[7] ..... B63C 11/02

[52] U.S. Cl. ..... 128/200.29; 128/205.24

[58] Field of Search ..... 128/200.27, 200.29, 128/201.11, 201.26, 201.27, 201.28, 204.26, 206.29, 861, 205.24, 912, 909, 206.22; 405/185; 114/326, 315

[56] References Cited

U.S. PATENT DOCUMENTS

| | | | |
|---|---|---|---|
| 2,485,039 | 10/1949 | Cousteau et al. | 128/145 |
| 2,747,572 | 5/1956 | Gagnan | 128/145 |
| 2,865,369 | 12/1958 | Kline | 128/142 |
| 3,147,499 | 9/1964 | Nelson et al. | 9/313 |
| 3,669,109 | 6/1972 | Cheffers et al. | 128/147 |
| 4,002,166 | 1/1977 | Oliver | 128/142.2 |
| 4,010,746 | 3/1977 | Pedersen | 128/147 |
| 4,079,735 | 3/1978 | Gaffney | 128/142.2 |
| 4,304,229 | 12/1981 | Curtin | 128/201.11 |
| 4,345,592 | 8/1982 | Giorgini et al. | 128/204.46 |
| 4,345,593 | 8/1982 | Sullivan | 128/204.26 |
| 4,356,820 | 11/1982 | Trinkwalder | 128/204.26 |
| 4,815,893 | 3/1989 | Feder | 405/186 |
| 5,203,324 | 4/1993 | Kinkade | 128/201.11 |
| 5,315,987 | 5/1994 | Swann | 128/201.28 |
| 5,379,762 | 1/1995 | Kobayashi | 128/201.28 |
| 5,570,702 | 11/1996 | Forman | 128/842 |
| 5,755,222 | 5/1998 | Pansard et al. | 128/204.27 |
| 5,771,885 | 6/1998 | Putrello | 128/205.27 |
| 5,829,432 | 11/1998 | Semeia | 128/201.27 |
| 5,871,011 | 2/1999 | Howell et al. | 128/206.22 |

*Primary Examiner*—Aaron J. Lewis
*Assistant Examiner*—Teena K Mitchell

[57] ABSTRACT

A mouthpiece for use with breathing devices of the type used by scuba divers is provided. The mouthpiece includes-at least one no-return valve to allow exhalation directly into the ambient environment. Additional no-return valves can be incorporated into the inhalation pathway to prevent fluids from flowing back into the regulator housing. In one embodiment, an inlet no-return valve is located in the respiratory port tube of the regulator. In other embodiments, an inlet no-return valve is located in the mouthpiece itself. The disclosed invention keeps the interior spaces of the regulator clean and dry even when the regulator is not in place, thus extending regulator life and preventing a dangerous and irritating free-flow condition from occurring due to icing during cold water use. Saliva and expired air with its attendant moistures and pathogenic entities are prevented from entering the regulator housing. The mouthpiece is easily detachable and can be sanitized between uses, making it particularly well suited for rental and instructional purposes. The mouthpiece can be variously constructed to differentiate common-use mouthpieces from those owned individually.

17 Claims, 3 Drawing Sheets

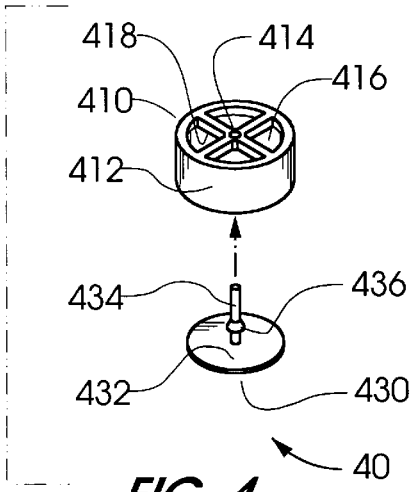
FIG. 4
FIG. 5
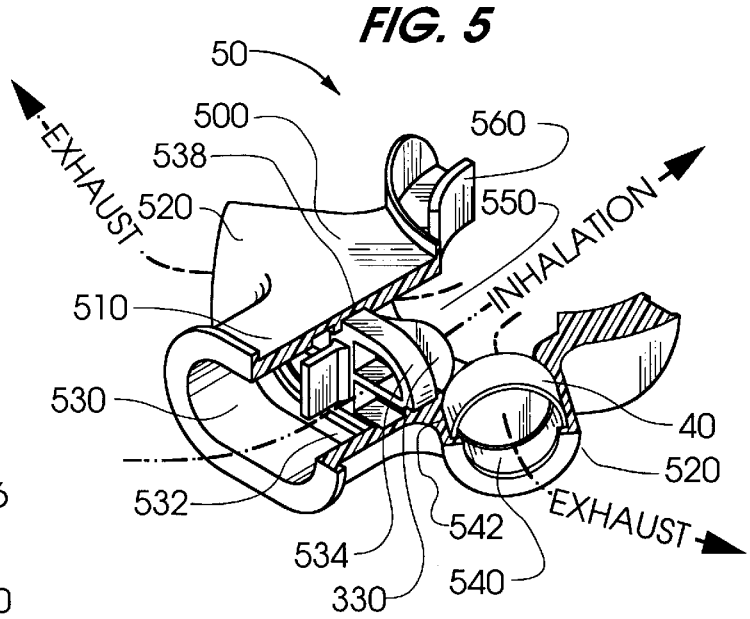
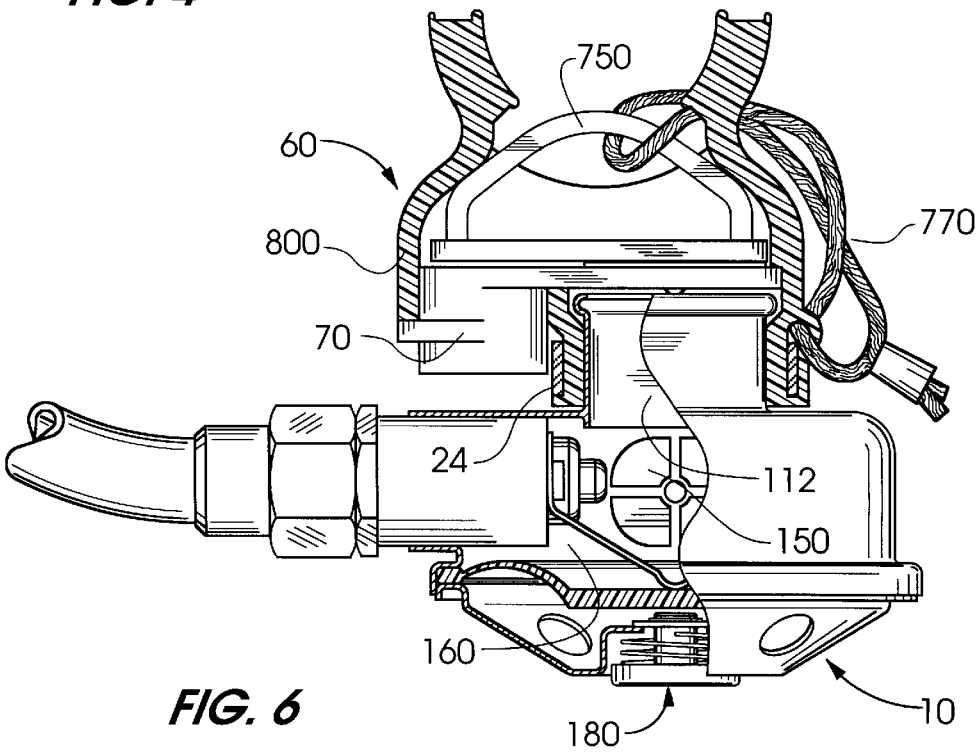
FIG. 6

SYSTEM AND METHOD TO PREVENT THE TRANSMISSION OF PATHOGENIC ENTITIES BETWEEN THE MULTIPLE USERS OF SECOND STAGE REGULATORS

FIELD OF THE INVENTION

The present invention relates to the field of scuba diving and, more particularly, to mouthpieces used with diving regulators.

BACKGROUND OF THE INVENTION

Regulators are devices that allow scuba divers to breathe air, or the like, while under water. The regulator uses valves to release air from high pressure tanks, typically through the action of an inhalation responsive diaphragm. Most often, a first stage regulator is attached to the tank. A second stage regulator is then connected to the first by a flexible hose and is supported by a mouthpiece retained in the mouth of the diver. This configuration requires minimal breathing effort since it locates the inhalation responsive elements closer to the center of pressure of the diver's lungs.

The regulator further includes a no-return exhaust valve mounted within the housing or incorporated into the inhalation diaphragm. Since exhalation occurs back through the regulator, the inhalation chamber is filled with expired air before the next inhalation cycle. U.S. Pat. No. 2,747,572, to Gagnan, locates the demand valve close to the respiratory port while placing the exhaust valve at a much greater distance, thus minimizing, though not entirely eliminating, the re-inhalation of expired air.

Due to its open nature, the second stage regulator can flood with corrosive salt water and abrasive sand and silt. U.S. Pat. No. 4,079,735, to Gaffney, shows a plug that fits into the mouthpiece to prevent the regulator from flooding when not in use, thus extending its serviceable life. However, the regulator may still flood when the plug is removed before use.

Most regulators release air directly into the respiratory port. A resultant venturi lowers the inhalation chamber pressure and reduces inhalation effort. However the venturi can become self-sustaining and spontaneous free-flow of air may occur if the regulator is not in place in the diver's mouth. U.S. Pat. No. 4,010,746, to Pedersen, teaches a vane extending into the respiratory port to draw water into the regulator. The inflow of water equalizes pressure across the diaphragm, thus closing the demand valve and disrupting the free-flow. Unfortunately, this approach requires that the regulator flood with harmful and corrosive sea water.

Compressed air cools as it exits the demand valve and moisture in the diver's exhalation condenses and can freeze on the demand valve if the regulator is used in cold water. This can cause the demand valve to remain open and result in an irritating and potentially dangerous uncontrolled free-flow. U.S. Pat. No. 4,356,820, to Trinkwalder, discloses a metallic vane to capture heat from the diver's exhalation and conduct it to the demand valve, thus preventing regulator free-flow due to icing.

Regulators are frequently shared by many divers, especially in rental operations and diver training programs. Pathogenic entities from one diver can be transmitted to the next. Some bacteria, such as tuberculosis, have become resistant to antibiotics. Hepatitis is difficult to kill and can survive on dry surfaces for great periods of time. And lethal new viruses, such as HIV, Marburg, and Ebola are emerging with an alarming frequency. Regulators are rinsed with fresh water after use, but this has little pathogen inactivating value. There is growing concern over this problem and some instructional agencies have even discontinued so-called buddy breathing exercises to minimize the risks associated with sharing regulators between students.

U.S. Pat. No. 5,570,702, to Forman, shows a disposable cover to place over the mouthpiece before each use and U.S. Pat. No. 5,755,222, to Pansard, discloses a fastener to facilitate mouthpiece replacement. Both teach against the common use of mouthpieces, thus averting the transmission of communicable diseases. However, both fail to recognize that pathogenic entities are carried past the mouthpiece and into the regulator with exhaled air and saliva. Once there, they can be transmitted to the next user.

None of these inventions, or others of the like, taken separately or collectively, resolve all problems resulting from the open nature of the modern regulator. Some do not even resolve the issues they were intended to. And so, even after fifty years, there still remains a need to improve the operation of diving regulators.

SUMMARY OF THE INVENTION

Accordingly, it is an object of the present invention to provide a mouthpiece for use with diving regulators that prevents saliva and exhaled air with their pathogenic entities from entering the regulator housing.

It is another object of the present invention to provide a mouthpiece for use with diving regulators that can be removed for cleaning and sanitizing.

It is still another object of the present invention to provide a mouthpiece for use with diving regulators that prevents water, sand, and silt from flooding the regulator.

It is still another object of the present invention to provide a mouthpiece for use with diving regulators that prevents free-flow due to icing when used in cold water.

It is yet another object of the present invention to provide a mouthpiece for use with diving regulators that prevents free-flow when the mouthpiece is not in place in the diver's mouth.

It is still another object of the present invention to provide a mouthpiece for use with diving regulators that minimizes the re-inhalation of expired air.

The present invention accomplishes its intended objectives by providing a detachable mouthpiece to sealingly interfit the respiratory port of a regulator. The mouthpiece includes its own exhalation pathway. One or more no-return valves can be provided to prevent saliva, exhaled air, pathogenic entities, water, sand, and silt from entering the regulator.

Since both individuals and common-use agencies may use a mouthpiece of the present invention, it is possible that confusion might occur over which mouthpiece is in use. Therefore, it is still another object of the present invention to provide a mouthpiece that allows the user to differentiate common-use mouthpieces from those owned individually.

Further characteristics and advantages of the mouthpiece of the present invention will become apparent from a description of the preferred embodiments given hereinafter.

BRIEF DESCRIPTION OF THE DRAWINGS

FIG. 4 is an exploded view of an exhaust valve assembly suitable for use in the present invention.

FIG. 5 is an isometric view, shown in partial section, of a second preferred embodiment of a mouthpiece employing the principles of the present invention.

FIG. 6 is an elevational view, shown in partial section, of a third preferred embodiment of a mouthpiece of the present invention fitted to a second stage regulator.

DETAILED DESCRIPTION OF THE INVENTION

Figure 1:
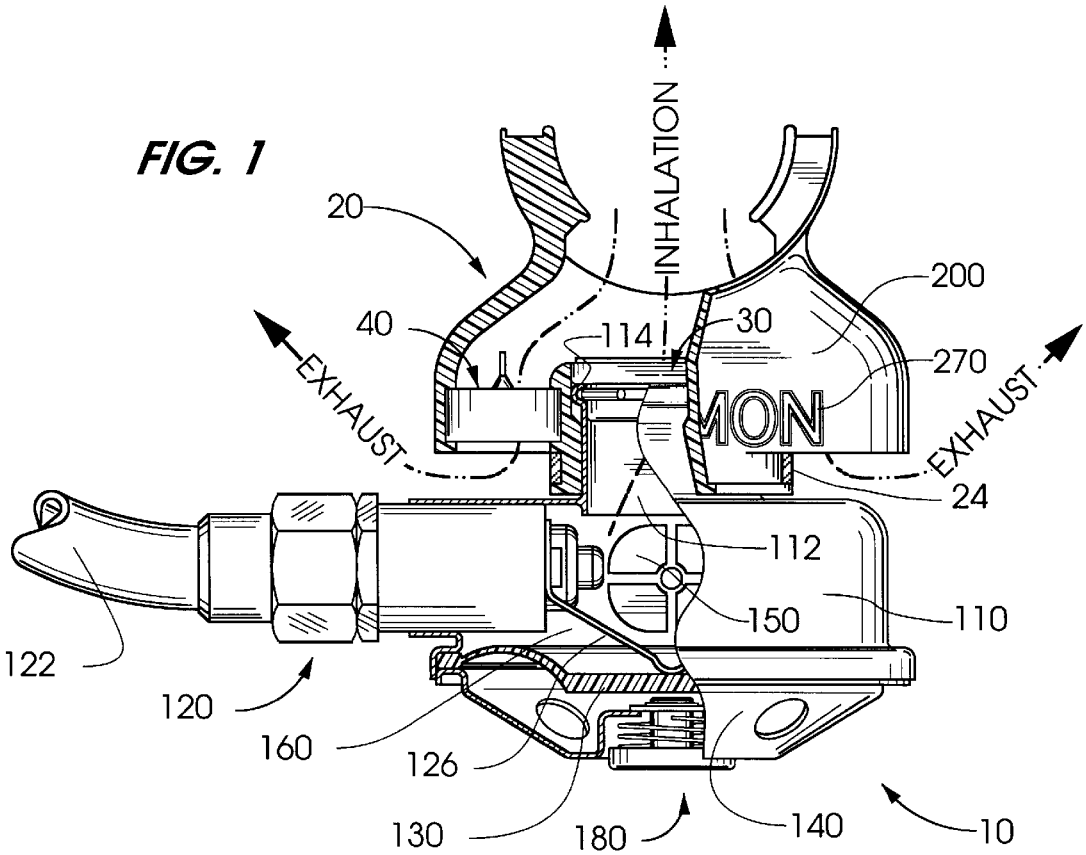
FIG. 1 is an elevational view, shown in partial section, of a first preferred embodiment of a mouthpiece of the present invention fitted to a second stage regulator.

FIG. 1 shows a first preferred embodiment of a mouthpiece of the present invention fitted to a second stage regulator 10. It should be understood that regulator 10 is an illustrative regulator and is just one of many breathing devices of the type used by divers that would accrue benefit from the use of a mouthpiece of the present invention. It should be further understood that as used herein, the term "air" refers to any breathable gas.

Regulator 10 comprises housing 110, demand valve 120, diaphragm 130, perforated cover 140, no-return exhaust valve 150 and purge button 180. Exhaust valve 150 is shown here as a mushroom type check valve. It allows flow in only one direction. Air stored in high pressure tanks is supplied to demand valve 120 through hose 122 from a first stage regulator (not shown). Inhalation induced differential pressure across diaphragm 130 ultimately deflects lever 126 and releases air from demand valve 120. Air can also be manually released by depressing purge button 180. Once released, air flows into inhalation chamber 160 and out respiratory port 112 to the diver (not shown). When regulator 10 is fitted with a conventional mouthpiece, exhalation occurs back through respiratory port 112 and inhalation chamber 160 and out exhaust valve 150. Regulator 10 can flood with water, sand, and silt when not in place in the diver's mouth. When fitted with a mouthpiece of the present invention, water, sand, silt, saliva, and expired air and their pathogenic entities are prevented or impeded from entering regulator 10.

First Preferred Embodiment

Figure 2:
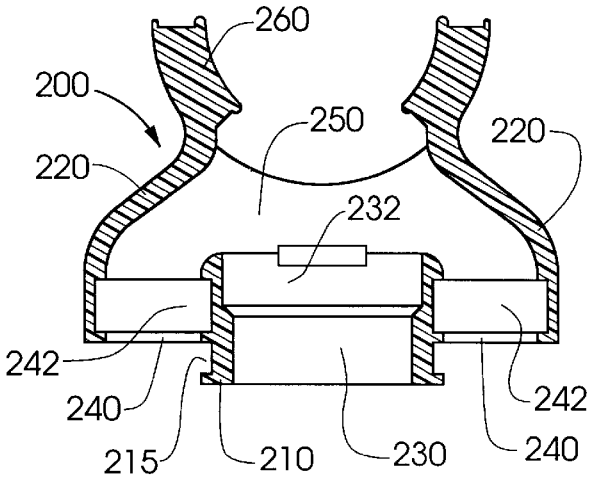
FIG. 2 is a sectional view of the housing of the mouthpiece shown in FIG. 1.

Mouthpiece 20, shown in FIG. 1, comprises housing 200, inhalation valve assembly 30, two exhaust valve assemblies 40, only one of which is shown, and optional locking device 24. Housing 200, better shown in FIG. 2, has an opening 230 formed by sleeve 210, mouthgrip opening 250 formed by mouthgrip 260 and vent openings 240 formed by sidearms 220. Sleeve 210 further includes groove 215 to receive an optional locking device 24 and recess 232 to receive respiratory port flange 114 and inhalation valve assembly 30. Sidearms 220 include recesses 242 to receive exhaust valve assemblies 40. When gripped in the mouth of the diver, mouthpiece 20 supports regulator 10 and thus maintains diaphragm 130 in a substantially fixed position relative to the diver's lungs. The regulator-mouthpiece combination has two separate exhaust routes; one through exhaust valve 150 and the other through mouthpiece openings 240.

Figure 3:
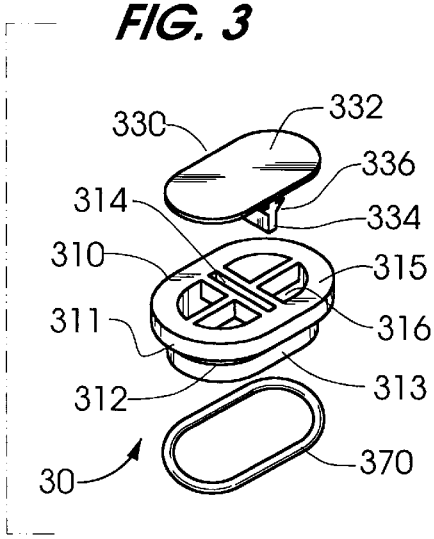
FIG. 3 is an exploded view of an inhalation valve assembly suitable for use in the present invention.

One inhalation valve assembly 30 well suited for use with mouthpiece 20 is shown in FIG. 3. Stem 334 of mushroom type valve 330 fits into slot 314 of valve body 310. Valve 330 is locked in place by protrusion 336 on stem 334. Flapper 332 forms a seal with valve body surface 315. Differential pressure in one direction will open flapper 332 and allow fluid to pass through openings 316. Differential pressure in the opposite direction forces flapper 332 more tightly against surface 315, thus preventing fluid flow. Barrel 313 of body 310 fits into respiratory port 112 of regulator 10. It includes groove 312 to receive O-ring 370. O-ring 370 engages with and seals against flange 114 of respiratory port 112. Surface 311 of valve body 310 can optionally form a seal with recess 232 of housing 200.

Exhaust valve assembly 40 is best shown in FIG. 4. Stem 434 of valve 430 fits through opening 414 of body 410 and is held in place by protrusion 436. Flapper 432 seals against webbed structure 418, allowing only one-way flow through openings 416. Surface 412 provides sealed engagement with housing 200 when installed within sidearm recess 242.

During inhalation, the diver's suction is transmitted through inhalation valve assembly 30 and causes air to be released from demand valve 120 into inhalation chamber 160. Air then flows to the diver along an inhalation fluid pathway comprising respiratory port 112, inhalation valve assembly 30, and mouthgrip opening 250. The one-way nature of exhaust valve assembly 40 prevents water from entering mouthpiece 20 during the inhalation cycle. During exhalation, inhalation valve assembly 30 closes and exhaled air vents along the fluid pathways comprising mouthgrip opening 250, sidearms 220, exhaust valve assemblies 40, and vent openings 240 into the surrounding water.

Saliva and expired air with its attendant moistures and their pathogenic entities are thus prevented from entering respiratory port 112 and inhalation chamber 160 of regulator 10. Free-flow due to icing is prevented. Inhalation valve assembly 30 is located on a plane with the diver's lips and, thus, no previously expired air is re-breathed. And when mouthpiece 10 is not in place in the diver's mouth, water, sand, and silt are prevented from entering regulator 10, thus extending regulator life.

In a rare case, regulator 10 may flood with water, chiefly through a seal failure of inhalation diaphragm 130 or exhaust valve 150. If not in use at the time, the diver can clear regulator 10 by depressing purge button 180 while orienting regulator 10 so that water will be expelled through inhalation valve 330. If in use, the diver can expel water through exhaust port 150 by exhaling into mouthpiece 20 while depressing purge button 180. Having two separate exhaust pathways is particularly advantageous. Pathogenic entities washed off the interior surfaces of the regulator, or carried into the regulator by water, will be expelled through exhaust port 150 and away from the diver.

Rental and instructional agencies can equip their regulators with mouthpieces of the present invention to extend the life of their regulators and minimize the risk of transmitting disease. The mouthpiece can be easily removed after use and sanitized or sterilized by methods that would otherwise prove detrimental to the regulator as a whole. Nevertheless, individuals may still prefer to use their own mouthpieces. It would be of benefit to common-use agencies and individual divers if they could differentiate one mouthpiece from another. Raised lettering 270, such as the last three letters of the word "COMMON" as shown on housing 200 of FIG. 1 can be used to differentiate a mouthpiece intended for common use from one privately owned. Other forms of indicium can also be used. For instance, a individually owned mouthpiece can be inscribed with an icon depicting a single diver, while a common-use mouthpiece can be inscribed with an icon or a group of icons representing multiple divers. A color coding scheme can also be used wherein common-use mouthpieces, or portions thereof, are of one color, and those owned individually are of another. Texture, finish and opacity can also act as indicium to differentiate one type of mouthpiece from another. Similar indicium can be used with any embodiment of the present invention.

Second Preferred Embodiment

While FIG. 1 shows a mouthpiece best suited for original equipment manufacture, FIG. 5 shows a mouthpiece well suited to retro-fit existing regulators. Mouthpiece 50 comprises housing 500 having sleeve 510 to form first opening 530 to receive respiratory port 112. Sleeve 510 includes recess 532 to receive flange 114, and recess 538 to receive inhalation valve body 534. Valve 330 is installed into valve body 534 to form an inhalation valve assembly. Housing 500 further includes mouthgrip 560 with mouthgrip opening 550 to provide fluid communication with the diver. Sidearms 520 provide vent openings 540 and have recesses 542 within to receive exhaust valve assemblies 40. Thus an inhalation fluid pathway is formed comprising respiratory port 112, inhalation valve body 534, valve 330 and mouthgrip opening 550. Exhalation occurs along two exhalation fluid pathways comprising mouthgrip opening 250, sidearms 220, exhaust assemblies 40 and vent openings 240 into the surrounding water.

Third Preferred Embodiment

Figure 7:
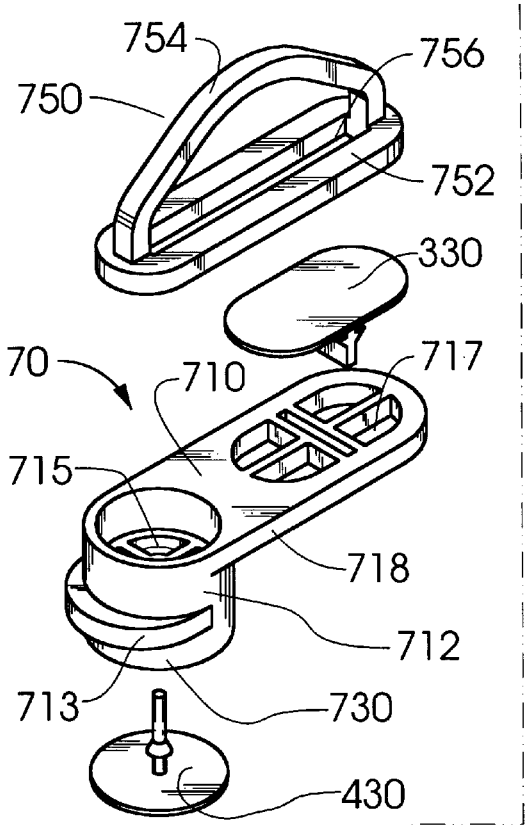
FIG. 7 is an exploded view of an inhalation—exhaust valve assembly and anti free-flow device suitable for use in the mouthpiece of FIG. 6.
Figure 8:
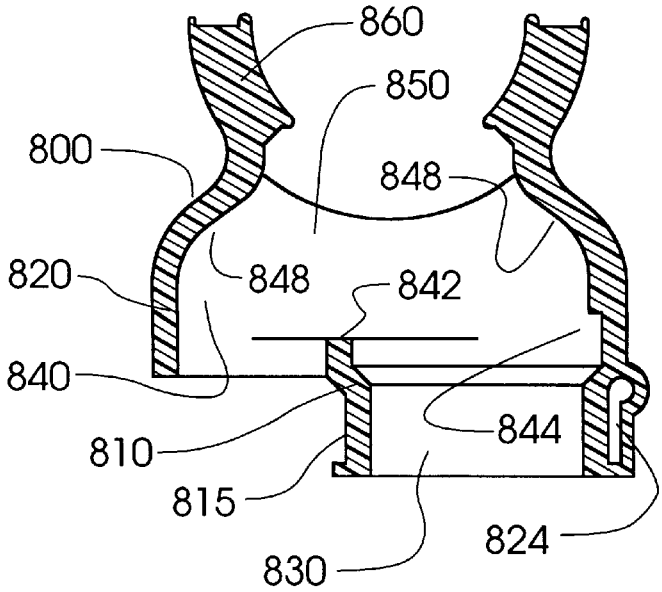
FIG. 8 is a sectional view of the housing of the mouthpiece shown in FIG. 6.

FIG. 6 shows another preferred embodiment of a mouthpiece well suited to retro-fit existing regulators. Mouthpiece 60 comprises housing 800 and valve plate assembly 70. Anti free-flow plug 750 is removed when regulator 10 is in use. Housing 800, best shown in FIG. 8, comprises sleeve 810 forming an opening 830 to receive respiratory port 112 and further includes mouthgrip 860 with mouthgrip opening 850 to provide fluid communication with the diver. Sidearm 820 provides vent opening 840 to provide a fluid pathway to the surrounding water. Valve plate assembly 70, best shown in FIG. 7, comprises plate 710, valve 330 and valve 430 to allow inhalation flow through openings 717 and exhalation flow through openings 715. When installed in housing 800, valve plate assembly 70 is supported by protrusion 844 on one end and flange 713 on the other. It is further supported by surface 842. Seals are formed by the interference of barrel 712 and plate surface 718 with housing 800 and sleeve 810 with respiratory port 112. Flanged recess 815 of housing 800 is provided for the optional use of locking device 24, such as a cable tie or Velcro strip. As with mouthpieces 20 and 50, mouthpiece 60 provides fluid pathways from regulator 10 to the diver and from the diver to the surrounding water and prevents saliva and exhaled air and their pathogenic entities from entering respiratory port 112 and inhalation chamber 160 of regulator 10.

Valve plate assembly 70 is installed into housing 800 by inserting it through any of openings 830, 840 or 850, urging it into place and snapping it into position. Mouthpiece 60 is easily disassembled for cleaning by distending housing 800 and extracting valve plate assembly 70. Mounting the inhalation and exhaust valves on a common carrier is particularly advantageous since fewer parts are involved and there is no ambiguity over valve orientation.

Distal end 730 of valve plate 710 has been shown as a short member. But, as a matter of choice, distal end 730 could be angled away from mouthpiece 60 and elongated to direct escaping bubbles away from the diver's vision. This bubble deflector can be an integral part of valve plate 710. Alternatively, a separate bubble deflector can be attached to barrel end 730 or to mouthpiece housing 800. Similar bubble deflectors can be used with any embodiment of the present invention.

Plug 750 prevents free-flow from occurring when regulator 10 is not in use by the diver. Plug 750 is inserted through opening 850 of housing 800 and is held in place by the interference of handle 754 with sidewalls 848. Plate 752 having slot 756 can be placed either in contact with or in close proximity to valve 330. In either case, valve 330 is prevented from opening freely, thus allowing pressure to increase within inhalation chamber 160 and preventing free-flow from occurring. If plate 752 is in hard contact with valve 330, excess pressure in inhalation chamber 160 will vent through exhaust valve 150. If plate 752 is only in close proximity to valve 330, excess pressure will vent through either exhaust valve 150 or inhalation valve 330, depending on the relative cracking pressures of each. Plug 750 can be clipped to the diver's harness to hold regulator 10 in place when not in use. Alternatively, plug 750 can be attached to mouthpiece 60 at slot 824 by lanyard 770. Plug 750, or the like, can be used with any embodiment of the present invention.

Manufacturing Considerations

Housings 200, 500 and 800 and valves 330 and 430 can be molded in flexible elastomers, such as silicone or neoprene rubber by known methods. Valve bodies 310, 410 and 534 and valve plate 710 can be economically molded in plastic or fabricated in metal. Any or all parts can be fabricated to include indicium to differentiate common-use mouthpieces from those owned individually.

The invention is not limited to the use of mushroom type no-return valves. There are many other types of valves known in the art that can be used with equal success. For instance, duck-bill, spring loaded plate, ball and cup, and swing plate types of no-return valves can be easily adapted for use with a mouthpiece of the present invention. Moreover, the number and placement of valves along the fluid pathways is not limited to that shown in the preferred embodiments. Multiple valves could be used in series or parallel and placed inside or outside the envelope of the mouthpiece housing.

The mouthpiece housing need not actually include a mouthgrip as such. The mouthgrip can be replaced by a mouthgrip mounting tube so that users can customize the mouthpiece assembly to their own liking. For instance, an anatomical mouthpiece, such as that shown in U.S. Pat. No. 5,203,324 to Kinkade, could be attached to the mouthpiece housing without losing the advantages of the present invention.

Housings 200, 500 and 800 have been illustrated as singular molded entities, but, again, no such limitation is intended. Housings could just as well be fabricated as multi-part assemblies and can include special adapters or the like to more readily facilitate attachment and sealing to respiratory ports of different design or dimension than that illustrated herein. Conversely, a mouthpiece housing with integral inhalation and exhaust valves could be molded as a single unit.

Respiratory port 112 of regulator 10 has been shown as an outwardly extending tube. Again, no such limitation is intended. The respiratory port of regulator 10 could also be manufactured as an inwardly extending tube or as a simple opening. A mouthpiece employing the principles of the present invention could be adapted to sealingly interfit respiratory ports of any design without departing from the novel scope and nature of the invention.

The diver or a manufacturer could eliminate or render inoperative exhaust valve 150 if a mouthpiece of the present invention is to be used with the breathing device. While this eliminates one possible leak path into the regulator, it sacrifices the advantage of having independent exhaust pathways. Nevertheless, if such a modification were made to the regulator, the inhalation valve could also be eliminated from the mouthpiece design, although several more of the advantages of the mouthpiece would be lost. Since there would be no exhalation pathway through the regulator housing, exhaled air with its attendant moisture and pathogenic entities would be impeded from entering the inhalation chamber of the regulator. However, flooding would occur if the regulator were not in place in the diver's mouth.

While the present invention has been shown in what is thought to be its most practical embodiments, it will be apparent to those skilled in the art that numerous modifications can be made without departing from the novel scope of the invention. Hence, the proper scope of the present invention should be determined only by the broadest interpretation of the appended claims so as to encompass all such modifications and equivalents.

What is claimed as being new and novel is:

1. In a system for conveying air to a diver from a second stage regulator that includes an inhalation chamber having a mouthpiece port, a valve that releases air to said mouthpiece port in response to inhalation through said mouthpiece port, and a regulator exhaust pathway communicating with said inhalation chamber that establishes one-way communication from said inhalation chamber to the ambient to convey exhaled air through said mouthpiece port, the improvement comprising:

a replaceable mouthpiece comprising a unitary housing including a sleeve adapted to be coupled to said mouthpiece port, a vent opening in said unitary housing, an inhalation pathway in said unitary housing establishing one-way fluid communication through said mouthpiece port to convey air from said mouthpiece port during inhalation and to prevent exhaled air from passing through said mouthpiece port and said regulator exhaust pathway during exhalation, and an exhalation pathway in said unitary housing establishing one-way fluid communication through said vent opening to convey exhaled air to said vent opening during exhalation, whereby, during use, said inhalation chamber remains free of exposure to pathogenic entities in exhaled air.

2. The system according to claim 1 wherein the improvement further includes a plug removably insertable into said unitary housing to block said inhalation pathway.

3. The system according to claim 1 wherein said exhalation pathway in said unitary housing comprises a no-return valve.

4. The system according to claim 1 wherein said inhalation pathway in said unitary housing comprises a no-return valve.

5. The system according to claim 1 wherein the improvement further includes indicium to differentiate common-use replaceable mouthpieces from non-common use replaceable mouthpieces.

6. The system according to claim 5 wherein said indicium is selected from the group comprising markings, lettering, icons, color, texture, finish, and opacity.

7. In a system for conveying air to a diver from a second stage regulator that includes an inhalation chamber having a mouthpiece port, a valve that releases air to said mouthpiece port in response to inhalation through said mouthpiece port, and a regulator exhaust pathway communicating with said inhalation chamber that establishes one-way communication from said inhalation chamber to the ambient to convey exhaled air through said mouthpiece port, the improvement comprising:

a replaceable mouthpiece comprising a unitary housing including a sleeve adapted to be coupled to said mouthpiece port, a mouthgrip opening in said unitary housing, a vent opening in said unitary housing that is exposed to the ambient, a first no-return valve in said unitary housing enabling flow of air through said mouthpiece port to said mouthgrip opening and preventing backflow of exhaled air through said mouthpiece port and said regulator exhaust pathway, and a second no-return valve in said unitary housing enabling flow of exhaled air from said mouthgrip opening to said vent opening and preventing backflow of the ambient into said mouthgrip opening, whereby, during use, said inhalation chamber remains free of exposure to pathogenic entities in exhaled air.

8. The system according to claim 7 wherein the improvement further includes a plug removably insertable into said unitary housing to block flow of air through said first no-return valve.

9. The system according to claim 7 wherein said second no-return valve comprises a flapper adapted to open in response to differential pressure.

10. The system according to claim 7 wherein said first no-return valve comprises a flapper adapted to open in response to differential pressure.

11. The system according to claim 10 wherein the improvement further includes a plug removably insertable into said unitary housing to block flow of air through said flapper.

12. The system according to claim 11 wherein said plug comprises a plate removably insertable through said mouthgrip opening.

13. The system according to claim 7 wherein said first and second no-return valves comprise flappers adapted to open in response to differential pressure and said unitary housing comprises a body and a carrier, said carrier at least partially disposed within said body and mounting said flappers.

14. The system according to claim 13 wherein the improvement further includes a plate removably insertable through said mouthgrip opening to block flow of air through said first no-return valve flapper.

15. The system according to claim 7 wherein the improvement further includes indicium to differentiate common-use replaceable mouthpieces from non-common-use replaceable mouthpieces.

16. The system according to claim 15 wherein said indicium is selected from the group comprising markings, lettering, icons, color, texture, finish, and opacity.

17. A method for preventing pathogenic entities in the exhalation of a diver from contaminating a second stage regulator of the type including an inhalation chamber having a mouthpiece port, a valve that releases air to said mouthpiece port in response to inhalation through said mouthpiece port, and a regulator exhaust pathway communicating with said inhalation chamber that establishes one-way communication from said inhalation chamber to the ambient to convey exhaled air through said mouthpiece port, the method comprising the steps of:

i. providing a replaceable mouthpiece comprising a unitary housing including a vent opening and a sleeve adapted to be coupled to said mouthpiece port;

ii. providing said replaceable mouthpiece with an inhalation pathway establishing one-way fluid communication through said mouthpiece port to convey air from said mouthpiece port during inhalation and to prevent exhaled air from passing through said mouthpiece port and said regulator exhaust pathway during exhalation; and iii. providing said replaceable mouthpiece with an exhalation pathway establishing one-way fluid communication through said vent opening to convey exhaled air to said vent opening.

* * * * *